United States Patent [19]

Hayashi et al.

[11] 4,022,621

[45] May 10, 1977

[54] PHOTOGRAPHIC DEVELOPER COMPOSITION

[75] Inventors: Katsumi Hayashi; Yoo Iijima, both of Minami-ashigara, Japan

[73] Assignee: Fuji Photo Film Co., Ltd., Minami-ashigara, Japan

[22] Filed: Sept. 12, 1975

[21] Appl. No.: 612,881

Related U.S. Application Data

[63] Continuation-in-part of Ser. No. 393,362, Aug. 31, 1973, abandoned.

[30] Foreign Application Priority Data

Sept. 1, 1972 Japan ..... 47-87704

[52] U.S. Cl. ..... 96/66.3; 96/66 R

[51] Int. Cl.[2] ..... G03C 5/30

[58] Field of Search ..... 96/66, 66.3

[56] References Cited

UNITED STATES PATENTS

| | | | |
|---|---|---|---|
| 3,232,761 | 2/1966 | Allen et al. | 96/66 R |
| 3,573,914 | 4/1971 | Masseth | 96/66.4 |
| 3,615,488 | 10/1971 | Drago | 96/66 R |
| 3,708,303 | 1/1973 | Salesin | 96/66 R |
| 3,793,027 | 2/1974 | Okutsu et al. | 96/66.3 |
| 3,833,378 | 9/1974 | Hayashi | 96/66.3 |

*Primary Examiner*—Mary F. Kelley

*Attorney, Agent, or Firm*—Sughrue, Rothwell, Mion, Zinn & Macpeak

[57] ABSTRACT

A photographic developer composition containing (1) a developing agent, (2) a carbonyl-bisulfite, (3) a carbonate and (4) a primary or secondary alkanolamine, the alkanolamine being present in a molar amount less than the amount of said carbonylbisulfite.

6 Claims, No Drawings

PHOTOGRAPHIC DEVELOPER COMPOSITION

This application is a continuation-in-part application of Ser. No. 393,362, filed Aug. 31, 1973, now abandoned.

BACKGROUND OF THE INVENTION

1. Field of the Invention

The present invention relates to a photographic developer composition and, more particularly, it relates to a photographic developer composition for developing high contrast photographic materials for use in the graphic arts.

2. Description of the Prior Art

In the field of the graphic arts in which photographic lines and half-tone dots are required, high contrast photographic light-sensitive materials are used. In the development of exposed high contrast photographic materials, an infectious developer is employed to prevent the formation of middle density regions (to be referred to as "fringe") which detrimentally influence the printed images.

Usually, an infectious developer is an alkaline processing solution containing a dihydroxybenzene-type developing agent and an aldehyde-alkali hydrogensulfite adduct. Since this type of developer contains free sulfite ion only in a small amount, their stability is seriously impaired as compared with usual black-and-white developers. In particular, in processing with an automatic developing machine to which a developer must be supplemented in order to retain the developing capability of the developer solution, poor stability results in various disadvantages. Because, the capability of the supplemented developer must be measured, which is quite time-consuming, before effecting the processing, and, in addition, it is difficult to adjust the half-tone gradation obtained with the supplemented developer to that obtained with the fresh developer. Such reduction in processing capability becomes serious with longer processing periods of time. In addition, where the solution is left for a long period of time, the sensitivity and the dot quality are not restored at all even when a supplementary developer is added thereto, and black spot-like stains are formed.

It is, therefore, an object of the present invention to provide a photographic developer composition which provides good dot quality.

Another object of the present invention is to provide a stable photographic developer composition.

A further object of the present invention is to provide a process for developing a high contrast photographic material with a stable photographic developer composition.

Still a further object of the present invention is to prepare a photographic original printing plate having excellent dot quality using a stable photographic developer composition.

SUMMARY OF THE INVENTION

As a result of various investigations for attaining the above-described objects, the inventors have found a photographic developer composition containing (1) a developing agent, (2) a carbonylbisulfite, (3) a carbonate, (4) a bromide and (5) less than an equimolar amount, based on the amount of the carbonylbisulfite, of a primary or secondary alkanolamine.

DETAILED DESCRIPTION OF THE INVENTION

It is known to add an alkanolamine to a photographic developer (e.g., U.S. Pat. Nos. 1,925,557, 2,388,816, 3,573,914, 3,615,488 and 3,708,303). However, no description has appeared as to the combination of a carbonylbisulfite, a carbonate and less than an equimolar amount, based on the amount of the carbonylbisulfite, of an alkanolamine. That is, the feature of the present invention lies in the above-described combination. With the combination specific effects which have not heretofore been expected are obtained.

It is sufficient for the photographic developer composition of the present invention to contain the above-described components upon use, and the form of the composition is in no way limited. That is, the composition can be in the form of a powder or a liquid. Also, each component of the composition can be separately packaged prior to use. Furthermore, it can be formed as a easy to handle thick or viscous solution.

The developing agent includes generally known dihydroxybenzenes. Representative of the dihydroxybenzenes are P-dihydroxybenzenes such as hydroquinone chlorohydroquinone, bromohydroquinone, isopropylhydroquinone, toluhydroquinone, methylhydroquinone, 2,3-dichlorohydroquinone, 2,5-dimethylhydroquinone, and the like. Of these, hydroquinone is generally used. The developing agents can be used alone or in combination and are present in an amount of from about 0.05 to about 0.5 mol, preferably about 0.1 to about 0.3 mol, per 1 liter of the developer composition.

A small amount of sulfite ion (about 0.005 to about 0.05 mol) is often contained in the developer composition and, in order to maintain this sulfite ion concentration, a sulfite ion buffer is used. A carbonylbisulfite is used for this purpose in the invention. Illustrative of the carbonylbisulfites are aldehyde-bisulfites such as formaldehyde-sodium hydrogensulfite adduct, ketone-bisulfites such as acetone-sodium hydrogensulfite adduct, and the like. Carbonylbisulfites are well known in the art, and a suitable one can be appropriately selected for use by one of ordinary skill in the art. Of these, formaldehydebisulfite is particularly preferred. The amount of the carbonylbisulfite used is about 0.1 to about 1.0 mol per 1 liter of the developer.

The carbonate salts used as the alkali agent include various salts, but the alkali metal salts such as sodium carbonate, potassium carbonate, etc. are suitable from a practical stand point. The amount of the carbonate used is about 0.05 to about 1.0 mol, preferably 0.1 to 0.7 mol per 1 liter of the developer. If the carbonate is not included in the developer, the contrast and half-tone dot quality of images are reduced, and the fringe of the images is increased. It is desirable to adjust the pH of the developer solution to not less than 8, preferably 9 to 11, by adding the carbonate. However, it is also possible to adjust the pH to this desirable region by adding a conventional pH-adjusting agent such as sodium hydroxide, acetic acid, boric acid or the like. Without the carbonate, the contrast of the images is lowered and fringes are formed to such an extent that the half-tone dot quality is reduced. Therefore, the addition of the carbonate salt is necessary and indispensable.

Illustrative primary or secondary amines which can be contained in the photographic developer composition of the present invention are 2-aminoethanol, 1-amino-2-propanol, 2-amino-2-methyl-1-propanol, 2-amino-2-methyl-1,3-propanediol, 2-amino-2-(hydroxymethyl)-1,3-propanediol, 3-amino-1-propanol, 2,2'-iminodiethanol, di-isopropanolamine, 2-isopropylaminoethanol, 2-methylaminoethanol, 2-ethylaminoethanol, and the like. These can be used alone or in combination. Of these, 2,2'-iminodiethanol is particularly preferred. The alkanolamines which can be used in the present invention are those desclosed in U.S. Pat. No. 3,573,914, and are used up to but less than an equimolar amount, preferably up to 0.3 mol per mol, based on the amount of the carbonylbisulfite. A particularly preferred concentration is about 0.4- to 0.9-mol per mol. If the amount of alkanolamine is greater than an equimolar amount based on the amount of the carbonylbisulfite, the contrast of images is reduced and, at the same time, the half-tone dot quality is markedly decreased due to the formation of fog. Therefore, use of less than an equimolar amount is extremely important.

The bromide is employed as a restrainer. If the bromide is not employed, the sensitivity is highly increased and so the contrast of images is not increased, whereby high-quality images cannot be obtained. The bromide is an alkali metal bromide (such as sodium bromide, potassium bromide, etc.) or an ammonium bromide.

The photographic developer composition of the present invention can further contain retarder such as an polyalkylene oxide, etc.; an antifoggant such as benzotriazole, 5- or 6- nitroindazole, 1 -phenyl-5-mercaptotetrazole, etc.; an antioxidant such as ascorbic acid, etc.; and an organic solvent such as triethylene glycol, dimethylformamide, methanol, cellosolve, etc., as described in U.S. patent application Ser. No. 315,776 filed on Dec. 15, 1972.

The high contrast photographic light-sensitive materials for which the developer composition of the invention is suitable are generally silver halide emulsions such as silver chloride emulsion, silver chlorobromide emulsion, or silver chloroiodide emulsion, a silver chlorobromide emulsion or a silver chlorobromoiodide emulsion containing at least 50 mol%, particularly more than 75 mol%, of silver chloride is especially suitable. These light-sensitive materials can contain as the dispersing agent for silver halide hydrophilic colloidal substances such as gelatin, gelatin derivatives (e.g., phthaloylated gelatin, malonoylated gelatin, etc.), cellulose derivatives (e.g., hydroxyethyl cellulose, carboxymethyl cellulose, etc.), dextrin, soluble starch (e.g., alkali starch, etc.), hydrophilic high polymers (e.g., polyvinyl alcohol, polyvinyl pyrrolidone, polyacrylamide, polystyrenesulfonic acid, etc.), and the like. Also, these light-sensitive materials can contain hydrophobic high polymers such as polyalkyl acrylate and a gelatin plasticizer such as glycerin trimethanolpropane. These are described in U.S. Pat. Nos. 3,294,540; 3,516,830; 3,625,689; 3,615,524; and 3,600,174; British Pat. No. 1,163,724; and U.S. patent application Ser. No. 505,462 filed on Oct. 28, 1965.

The emulsions used for these light-sensitive materials can be sensitized in various manners during the production thereof or upon coating. For example, they can be chemically sensitized by methods well known in the art using sodium thiosulfate, alkylthiourea or the like, gold compounds such as a complex salt between monovalent gold and thiocyanic acid, or combinations thereof. Furthermore, they can contain heavy metals such as platinum, palladium, iridium, rhodium, cadmium, etc. Also, the emulsions can be orthochromatically or panchromatically sensitized by adding color sensitizing agents such as a cyanine dye, merocyanine dye, etc.

In addition; the emulsions can contain a dot-improving agent such as polyalkylene oxides and amine compounds (Japanese Pat. Publication No. 14402/64, German Pat. OLS No. 1,932,882, Japanese Pat. Publication No. 23466/65), sodium benzenethiosulfate, benzotriazole, 1,3,3*a*,7-tetrazaindene derivatives (Japanese Pat. Publication Nos. 15715/64 and 17903/66). Still further, the emulsions can be hardened with a hardener such as formaldehyde, resorcylaldehyde, dimethylolurea, 2,4-dichloro-6-hydroxy-1,3,5-triazine (U.S. Pat. No. 3,325,287), mucochloric acid, etc. or can contain a surface active agent such as saponin for facilitating the coating. Also, they can contain a development progress-improving agent such as a 3-pyrazolidone derivative or a pyrazolone derivative. The emulsion can also contain a development accelerator such as a quaternary ammonium salt or a cationic surfactant.

The support of the light-sensitive material applicable to the present invention is not particularly limited and glass, cellulose acetate, polystyrene, polycarbonate, polyethylene terephthalate, resin-coated paper, etc., can be used.

The photographic developer composition of the present invention is so stable that it can be left for several weeks in a developing machine as a single solution without change. Therefore, it is not necessary to spend a lot of time on controlling the solution. In addition, since sensitivity correction is unnecessary, the solution can be used at any time. Furthermore, by using the composition of the present invention, images with good quality as compared with the conventional images can be obtained. Therefore, as long as the composition of the present invention is used, even the unskilled can easily obtain printing plates with good quality.

The present invention will now be described in greater detail by reference to the following non-limiting examples which serve to specifically demonstrate the effects of the invention. Unless otherwise indicated, all parts and percents are by weight.

EXAMPLE 1

A silver halide emulsion comprising 75 mol% of silver chloride, 0.2 mol% of silver iodide and the balance silver bromide was subjected to gold sensitization and sulfur sensitization, and was then optically sensitized with 3-carboxymethyl-5-[2-(3-ethylthiazolinylidene)ethylidene]-rhodanine. Furthermore, a polyoxy ethylene nonyl phenyl ether, containing 50 ethylene oxide groups, and the development accelerator represented by the formula;

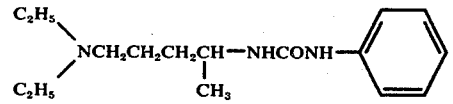

described in Japanese Patent Publication No. 23465/65 were added thereto. Then, mucochloric acid was added thereto, and the resulting mixture was mixed with a polybutyl methacrylate polymer followed by applying it to film bases. An exposure wedge for use in sensitometry was photographed on the thus obtained lith films through a 150-line magenta contact screen. Thereafter, each of the above-described light-sensitive materials were processed at 27° C for 3 minutes using an automatic developing machine (trade name: FG-14L, made by Fuji Photo Film Co., Ltd.). Developers B, C, D and E were used for comparison.

The results of the processing and the stability of the developers are shown in Table 2. For convenience, the results of the processing were rated in terms of contrast (i.e., gamma) and half-tone dot quality. Contrast is the slope at the linear portion of the graph of optical density versus logarithmic value of exposure. When the photographic materials are high in contrast, it is contrasty and suitable as an original printing plate. If the contrast is low, the photographic material is unsuitable. The half-tone dot quality was rated by measuring the fringes at the portions where the dot area ratio was 20% and where the dot area ratio was 50% using a tracing method with a microdensitometer.

TAble 1

| Additive | Developer Composition (g) A | B | C | D | E |
|---|---|---|---|---|---|
| Formaldehyde-Sodium Hydrogen Sulfite | 50 | 50 | 50 | 50 | — |
| Sodium Sulfite | 3.0 | 3.0 | 3.0 | 3.0 | 3.0 |
| Sodium bis-(2-Hydroxyethyl)-aminomethanesulfonate | — | — | — | — | 82 |
| Boric Acid | 7.5 | 7.5 | 7.5 | 7.5 | 7.5 |
| Hydroquinone | 22.5 | 22.5 | 22.5 | 22.5 | 22.5 |
| Potassium Bromide | 1.6 | 1.6 | 1.6 | 1.6 | 1.6 |
| Sodium Carbonate (monohydrate) | 55 | 55 | 55 | — | — |
| Sodium Hydroxide | — | — | — | 2.5 | — |
| 2,2'-Iminodiethanol | 18.1 | — | 44 | 18.1 | 39 |
| Water to make | 1 liter | 1 liter | 1 liter | 1 liter | 1 liter |

Table 2

| Developer | Contrast | Width of Fringe around Dot (μ) (Dot quality) 20% area | 50% area | Change in Sensitivity on Standing in an Automatic Developing Machine one day log E | 3 days log E |
|---|---|---|---|---|---|
| A | 12.5 | 10 | 8 | 0 | 0 |

Table 2-continued

| Developer | Contrast | Width of Fringe around Dot (μ) (Dot quality) 20% area | 50% area | Change in Sensitivity on Standing in an Automatic Developing Machine one day log E | 3 days log E |
|---|---|---|---|---|---|
| B | 11.3 | 12 | 10 | −0.2* | −0.5 |
| C | 3.4 | 29 | 25 | +0.1** | +0.2 |
| D | 3.0 | 28 | 27 | −0.4* | −0.9 |
| E | 5.2 | 30 | 29 | 0 | 0 |

*Desensitized
**Sensitized

From the results contained in Table 2, it can be seen that Developer Composition A of the invention is excellent in both contrast and dot quality as compared with the known Developer Composition B for high contrast photographic light-sensitive materials, and that the stability of Developer Composition A is improved.

On the other hand, if the alkanolamine is added in an amount more than equimolar amount based on the carbonyl-bisulfite, the processing capability of the composition is seriously reduced and, conversely, the solution tends to become sensitized with the passage of time (Developer Composition C).

When the developer contains no carbonate and contains only a small amount of alkanolamine, the stability of the solution is poor, and the contrast and dot quality are seriously deteriorated. (Developer Composition D). Also, when the alkanolamine is contained in a large amount, the processing capability is deteriorated and the tone becomes reddish although the stability is improved to some extent. (Developer Composition E). Thus, such a solution cannot be used for preparing original printing plates.

EXAMPLE 2

The same experiment as in Example 1 of this invention was conducted using the following Developers F, G, H, I, J, K and L.

Table 3

| Additive | Developer Composition (g) F | G | H | I | J | K | L |
|---|---|---|---|---|---|---|---|
| Sodium Formaldehyde Bisulfite | 60 | 60 | 60 | 60 | 60 | — | — |
| Sodium Sulfite | 3.5 | 3.5 | 3.5 | 3.5 | 3.5 | 3.5 | 3.5 |
| sodium-bis-(2-Hydroxyethyl) aminomethane sulfonate | — | — | — | — | — | 115 | 115 |
| Boric Acid | 6 | 6 | 6 | 6 | 6 | 6 | 6 |
| Hydroquinone | 13.5 | 13.5 | 13..5 | 13.5 | 13.5 | 13.5 | 13.5 |
| Potassium Bromide | 2.0 | 2.0 | 2.0 | 2.0 | 2.0 | 2.0 | 2.0 |
| Sodium Carbonate | 70 | 70 | — | 70 | 70 | 70 | 70 |
| Potassium Hydroxide | — | *Sensitized | 4.2 | — | — | —— | |
| 2,2'-Iminodiethanol (DEA) | 23.5 | — | 42.3 | 32.9 | 42.3 | — | 9.4 |
| DEA/SFB (Molar ratio) | 0.5 | — | 0.9 | 0.7 | 0.9 | 1.0 | 1.2 |
| Water to make | 1 l | 1 l | 1 l | 1 l | 1 l | 1 l | 1 l |
| PH | 10.0* | 10.0 | 10.0 | 10.0 | 10.0 | 10.0 | 10.0 |

*Sodium hydroxide or acetic was added for PH adjustment.

Table 4

| | Developer F | G | H | I | J | K | L |
|---|---|---|---|---|---|---|---|
| Contrast | 11.3 | 11.8 | 5.2 | 10.4 | 10.2 | 8.2 | 6.4 |
| Dot Quality (μ) | | | | | | | |
| 20% dot | 7 | 5 | 29 | 9 | 9 | 18 | 17 |
| 50% dot | 9 | 7 | 30 | 11 | 12 | 20 | 22 |
| Automatic Processor Speed Change After 1 day's stay (log E) | 0 | −0.3 | −0.4 | −0.01 | −0.02 | −0.04 | +0.2** |
| Speed Change After | | | | | | | |

Table 4-continued

| | Developer | | | | | | |
|---|---|---|---|---|---|---|---|
| | F | G | H | I | J | K | L |
| 3 days' stay (log E) | −0.05 | −0.7 | −0.8 | −0.04 | −0.06 | 0 | −0.1 |

*Desensitized
**Sensitized

Developers F, I and J are the compositions of the present invention. Developer G has a high contrast and a good dot quality in view of the absence of 2,2'-iminodiethanol, but the solution tends to become desensitized with the passage of time, i.e., the stability of the solution is poor. With Developer H, the dots become reddish due to the remarkably late developing process because of the absence of carbonate. In such a case, the contrast is low and the dot quality is bad, and then, the stability of the solution is poor because of the presence of a smaller amount of amine than sodium formaldehyde bisulfite. Developer K, as well as Developer L, has a considerably good stability, but has low contrast and bad dot quality in the presence of an equimolar amount of the reactant of sodium formaldehyde with 2,2'-iminodiethanolamine. It is assumed that the acceleration of the physical development by the excess free amine which is not used in the addition reaction causes both deterioration of dot quality and lowering of contrast. In K the molar ratio DEA/SFB is 1.0 because of the presence of sodium-bis-(2-hydroxyethyl) aminomethane sulfonate (condensation product of equimolar amounts of DEA and SFB) and is 1.2 in L because of the presence of the sulfonate plus additional amount of DEA.

While the invention has been described in detail and with reference to specific embodiments thereof, it will be apparent to one skilled in the art that various changes and modifications can be made therein without departing from the spirit and scope thereof.

What is claimed is:

1. A photographic developer composition consisting essentially of (1)0.05 to 0.5 mol of a hydroquinone compound developing agent per liter of developer solution, (2) about 0.1 to 1.0 mol of an aldehyde-bisulfite or ketone-bisulfite per liter of developer solution, (3) about 0.05 to 1.0 mol of a carbonate per liter of developer solution, (4) about 0.3 mol to less than about 1 mol of a primary or secondary alkanolamine selected from the group consisting of 2-aminoethanol, 1-amino-2-propanol, 2-amino-2-methyl-1-propanol, 2-amino-2-methyl-1,3-propanediol, 2-amino-2-(hydroxymethyl)-1,3-propanediol, 3-amino-1-propanol, 2,2'-imino-diethanol, di-isopropanolamine, 2-isopropylaminoethanol, 2-methylaminoethanol and 2-ethylaminoethanol, per mol of said bisulfite, the alkanolamine being present in a molar amount less than the amount of said aldehyde-bisulfite or ketone-bisulfite and (5) a bromide restrainer.

2. The photographic developer composition of claim 1, wherein said developing agent is hydroquinone, chlorohydroquinone, bromohydroquinone, isopropylhydroquinone, toluhydroquinone, methylhydroquinone, 2,3-dichlorohydroquinone or 2,5-dimethylhydroquinone.

3. The photographic developer composition of claim 1, wherein said bisulfite is formaldehyde-sodium hydrogen sulfite adduct or acetone sodium hydrogen sulfite adduct.

4. The photographic developer composition of claim 1, wherein said carbonate is sodium carbonate or potassium carbonate.

5. A process for treating an imagewise exposed silver halide photographic element comprising at least 50 mol% silver chloride comprising developing said element with a developer composition consisting essentially of (1) about 0.05 to 0.5 mol of a hydroquinone compound developing agent per liter of developer solution, (2) about 0.1 to 1.0 mol of an aldehyde-bisulfite or ketone-bisulfite per liter of developer solution, (3) about 0.05 to 1.0 mol of a carbonate per liter of developer solution, (4) about 0.3 mol to less than about 1 mol of a primary or secondary alkanolamine selected from the group consisting of 2-aminoethanol, 1-amino-2-propanol, 2-amino-2-methyl-1-propanol, 2-amino-2-methyl-1,3-propanediol, 2-amino-2-(hydroxymethyl)-1,3-propanediol, 3-amino-1-propanol, 2,2'-iminodiethanol, di-isopropanolamine, 2-isopropylaminoethanol, 2-methylaminoethanol and 2-ethylaminoethanol, per mol of said bisulfite, the alkanolamine being present in a molar amount less than the amount of said bisulfite and (5) a bromide restrainer.

6. The process of claim 5, wherein said developing agent is hydroquinone, chlorohydroquinone, bromohydroquinone, isopropylhydroquinone, toluhydroquinone, methylhydroquinone, 2,3-kichlorohydroquinone or 2,5-dimethylhydroquinone.

* * * * *